US012752888B2

(12) United States Patent
Huiskamp et al.

(10) Patent No.: US 12,752,888 B2
(45) Date of Patent: Oct. 6, 2026

(54) FLOATING STRUCTURE

(71) Applicant: SOLARDUCK HOLDING B.V., Nijmegen (NL)

(72) Inventors: Ewoud Huiskamp, Delft (NL); Cornelis Frans Donald Hoogendoorn, Gouda (NL)

(73) Assignee: SOLARDUCK HOLDING B.V., Nijmegen (NL)

( * ) Notice: Subject to any disclaimer, the term of this patent is extended or adjusted under 35 U.S.C. 154(b) by 217 days.

(21) Appl. No.: 18/839,415

(22) PCT Filed: Feb. 14, 2023

(86) PCT No.: PCT/EP2023/053603
§ 371 (c)(1),
(2) Date: Aug. 16, 2024

(87) PCT Pub. No.: WO2023/156374
PCT Pub. Date: Aug. 24, 2023

(65) Prior Publication Data

US 2025/0171116 A1 May 29, 2025

(30) Foreign Application Priority Data

Feb. 18, 2022 (EP) ..... 22157425

(51) Int. Cl.
*B63B 39/03* (2006.01)
*B63B 35/44* (2006.01)

(52) U.S. Cl.
CPC ..... *B63B 39/03* (2013.01); *B63B 35/44* (2013.01); *B63B 2035/446* (2013.01)

(58) Field of Classification Search
CPC .... B63B 39/03; B63B 35/44; B63B 2035/446
(Continued)

(56) References Cited

U.S. PATENT DOCUMENTS

2011/0109094 A1 5/2011 Kenway et al.
2011/0247323 A1 10/2011 Kenway et al.
(Continued)

FOREIGN PATENT DOCUMENTS

CN 111749870 A 10/2020
EP 3147518 A1 3/2017
WO 2009076757 A2 6/2009

OTHER PUBLICATIONS

Perry et al. "Paper Number (Assigned by IFPE Staff) Compressed Air Energy Storage for Offshore Wind Turbines", Mar. 1, 2011, 7 pages.

(Continued)

*Primary Examiner* — T. Scott Fix
(74) *Attorney, Agent, or Firm* — Steven M. Koehler; Westman, Champlin & Koehler, P.A.

(57) ABSTRACT

A floating structure comprises a buoyant member including a surrounding wall within which a pressure reservoir for storage of compressed gas is provided and a compressor for supplying compressed gas to the pressure reservoir. The compressor is a liquid piston gas compressor including two vessels for containing a liquid and a gas to be compressed above the liquid and a pump for pumping a liquid between the vessels. At least the vessels are located within the surrounding wall of the buoyant member and are provided with respective closable inlets for receiving gas from outside the buoyant member and respective closable outlets through which the vessels communicate with the pressure reservoir so as to transfer compressed gas from the vessels to the pressure reservoir under operating conditions.

18 Claims, 5 Drawing Sheets

(58) Field of Classification Search
USPC ..... 114/125
See application file for complete search history.

(56) References Cited

U.S. PATENT DOCUMENTS

| | | | |
|---|---|---|---|
| 2014/0109561 | A1 | 4/2014 | Kenway et al. |
| 2014/0190155 | A1 | 7/2014 | Kenway et al. |

OTHER PUBLICATIONS

International Search Report and Written Opinion in corresponding International Application Serial No. PCT/EP2023/053603 dated Mar. 20, 2023.

FLOATING STRUCTURE

CROSS-REFERENCE TO RELATED APPLICATION(S)

This Application is a Section 371 National Stage Application of International Application No. PCT/EP2023/053603, filed Feb. 14, 2023 and published as WO 2023/156374 A1 on Aug. 24, 2023, in English.

BACKGROUND

The present invention relates to a floating structure, comprising a buoyant member including a surrounding wall within which a pressure reservoir for storage of compressed gas is provided and a compressor for supplying compressed gas to the pressure reservoir.

Such a floating structure is well-known in the prior art. In the known floating structure the compressor compresses a gas, for example ambient air, and is driven by an electric motor which is connected to a renewable energy source such as a series of PV panels. In the event that a demand for electrical power is low, redundant electrical power from the renewable energy source may be supplied to the electric motor for driving the compressor and supplying compressed gas to the pressure reservoir. Hence, redundant energy is stored in the form of compressed gas. In the event that less renewable energy is available, for example during the night in case of PV panels, the compressed gas can be converted to electrical power, for example by expanding the compressed gas over a turbine that is coupled to a generator.

SUMMARY

An object of the invention is to provide a floating structure in which the efficiency of energy storage in the form of compressed gas is relatively high.

This object is accomplished with the floating structure, which is characterized in that the compressor is a liquid piston gas compressor including two vessels for containing a liquid and a gas to be compressed above the liquid and a pump for pumping a liquid between the vessels, wherein at least the vessels are located within the surrounding wall of the buoyant member and are provided with respective closable inlets for receiving gas from outside the buoyant member and respective closable outlets through which the vessels communicate with the pressure reservoir so as to transfer compressed gas from the vessels to the pressure reservoir under operating conditions.

An advantage of the floating structure is that the liquid piston gas compressor keeps the temperature of the compressed gas at a relatively low level during compression due to heat transfer from the compressed gas in the vessels to the liquid, which leads to a relatively high efficiency of the energy conversion from electrical energy to stored compressed gas. Furthermore, the location of the vessels inside the surrounding wall of the buoyant member provides the opportunity to cool the liquid in the vessels and/or the compressed air in the pressure reservoir in a simple way by using water in which the buoyant member is positioned. Moreover, since both the pressure reservoir and the vessels of the liquid piston gas compressor are located inside the surrounding wall the distance between the pressure reservoir and the vessels can be minimized, hence minimizing pipe lengths causing relatively low flow losses.

Under operating conditions, when the compressed gas is supplied to the pressure reservoir, the inlet of a corresponding vessel may be open and its outlet may be closed when the liquid level in the vessel is lowered, whereas the outlet may be open and the inlet may be closed when the liquid level in the vessel rises.

In a particular embodiment the buoyant member has an upper side which lies above a lower side thereof when the floating structure is in an operational condition in which at least the lower side is immersed in water, wherein the vessels are located at a lower portion of the buoyant member and the pressure reservoir is located at an upper portion of the buoyant member. In the operational condition the vessels are close to water that envelopes the surrounding wall of the buoyant member, which facilitates to cool the liquid in the vessels. The low location of the vessels may have an advantageous effect in terms of stability of the buoyant member because of creating a relatively low centre of gravity.

The pump may also be located within the surrounding wall of the buoyant member. This means that lines between each of the vessels and the pump may be minimized.

The pump may be located inside one of the vessels, for example such that it is immersed in the liquid under operating conditions.

The pump may be driven by an electric motor.

In a particular embodiment, under operating conditions the electric motor is electrically connected to an electrical power source, preferably collected from renewable energy, such as a plurality of PV panels or a wind turbine, through an electrical circuit so as to operate the pump by electrical energy from the electrical power source, wherein the electrical power source is preferably provided at the floating structure. In case of a renewable energy source, this provides the opportunity to store redundant electric power generated by a renewable energy source in the form of compressed gas.

In an embodiment the liquid piston gas compressor is operable in reverse direction and the electric motor is operable as a generator such that expanding gas from the pressure reservoir drives the pump and the generator so as to generate electrical energy. In this case the pump may be a reversable pump. There may also be a separate turbine and a generator which is arranged parallel to the pump and driven by the liquid in order to convert expanding gas from the pressure reservoir into electrical energy. It is also conceivable to supply the compressed gas to an expanding device, such as a gas turbine, which is coupled to a generator for converting the energy from the compressed gas into electric power.

In a preferred embodiment at least a portion of the surrounding wall forms an enveloping wall of the pressure reservoir, since the surrounding wall is used for creating buoyancy as well as for sealing the pressure reservoir.

The pressure reservoir may be configured such that its allowable working pressure is at least 14 bar, but it is also conceivable that its allowable working pressure is at least 20, 30 or 40 bar.

Preferably the gas is air, since this can be easily supplied to the compressor from the ambient air which surrounds the buoyant member.

At least a portion of an outer wall of at least one of the vessels may be formed by a part of the surrounding wall of the buoyant member. In this case the surrounding wall is used for creating buoyancy as well as for creating an outer wall of at least one of the vessels. If a portion of the surrounding wall that coincides with at least a portion of the outer wall of at least one of the vessels is immersed in water the liquid may be cooled efficiently by the water under operating conditions.

One of the vessels may at least partly surround the other one of the vessels. For example, the vessels may be arranged concentrically with respect to each other, wherein the outer wall of the outer vessel may coincide with a portion of the surrounding wall of the buoyant member. When the surrounding wall at the level of the vessels and the wall of the inner vessel have circular circumferences this configuration minimizes volumetric losses of the vessels in case of varying dimensions of the surrounding wall due to shrink and expansion.

The liquid in the vessels be water. It may be seawater, but preferably the water is less corrosive than seawater. Nevertheless, an alternative liquid than water is conceivable.

In a particular embodiment the floating structure comprises a frame to which the buoyant member is mounted, which frame extends in a main plane, wherein a projected contour of the surrounding wall of the buoyant member on the main plane has a size in a first direction which is smaller than six times a size in a second direction perpendicular to the first direction, for example the size in the first direction is smaller than five, four or three times the size in the second direction or the size in the first direction is substantially equal to the size in the second direction. In the latter case the buoyant member may be cylindrical including a centreline which extends perpendicularly to the main plane.

In an embodiment the buoyant member has an upper side which lies above a lower side thereof when the floating structure is in an operational condition, wherein the distance between the upper side and the lower side is larger than three times the largest size of the surrounding wall in horizontal direction, but it is also conceivable that the distance is larger than four, five, six, eight or ten times the largest size of the surrounding wall in horizontal direction. For example, the buoyant member may have a circular cylindrical side wall including a vertical centreline and a length over diameter ratio which is larger than three, four, five, six, eight or ten, for example.

The frame may be a platform which extends in the main plane.

The frame may be part of a larger floating structure including a plurality of interconnected frames which may have the same shapes and which are movable with respect to each other.

In the operational condition the buoyant member may be fully submerged in the water.

The surrounding wall of the buoyant member may comprise a tapered circumferential wall such that a plurality of the same buoyant members can be nested inside each other during transport. For example, before being transported to an off-shore site the tapered buoyant members may be closed at their smallest sides and still open at their widest sides such that they fit inside each other, whereas they are separated from each other and closed at their widest sides after arrival at the off-shore site where the buoyant members are to be installed.

More in general, the surrounding wall of the buoyant member in a non-final state may be such that a plurality of the same buoyant members in the final state can be nested into each other in their non-final state.

The buoyant member may be a first buoyant member, whereas a second buoyant member may be mounted to the frame at a distance from the first buoyant member. The second buoyant member may be the same as the first buoyant member. It is also possible that the pressure reservoirs of the first and second buoyant members communicate with each other. It is further conceivable that only the first buoyant member is provided with the vessels of the liquid piston compressor, whereas the second buoyant member is not provided with vessels, but accommodates a pressure reservoir.

In a preferred embodiment the frame has an equilateral shape as seen from above and comprises three buoyant members.

In the event that the first and second buoyant members are the same, they may be configured such that they are operated out-of-phase. This means that they are operated alternatingly in order to level electrical power to the electric motors of the respective liquid piston gas compressors. Similarly, converting compressed gas into electrical power can also be controlled out-of-phase.

BRIEF DESCRIPTION OF THE DRAWINGS

The invention will hereafter be elucidated with reference to very schematic drawings showing embodiments of the invention by way of example.

DETAILED DESCRIPTION

Figure 1:
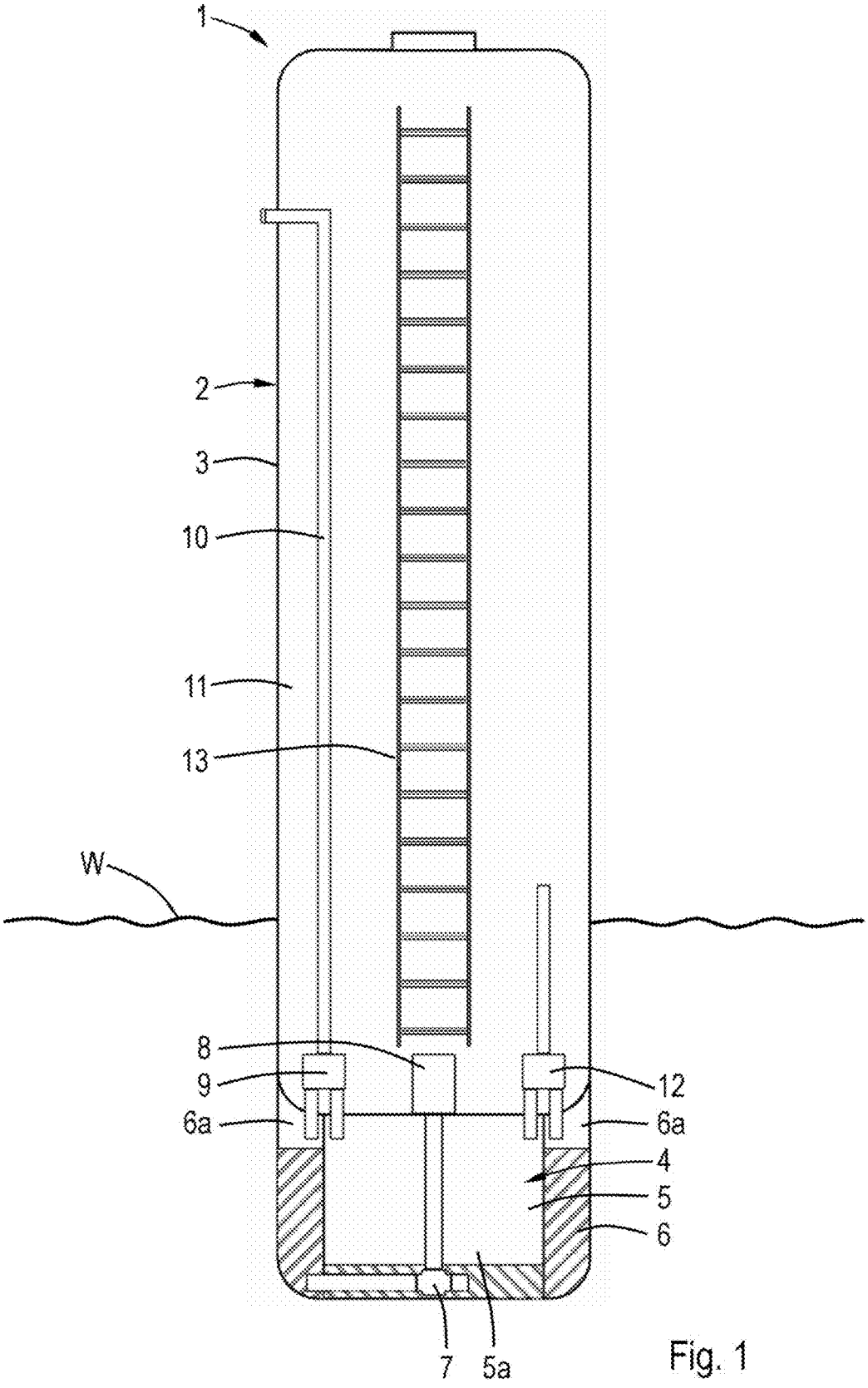
FIG. 1 is a sectional view of an embodiment of a floating structure.

FIG. 1 shows an embodiment of a floating structure 1 in an operational condition. The floating structure 1 comprises an elongate buoyant member 2 including a surrounding wall 3 in the form of a circular cylindrical tank having a closed upper side and a closed lower side. FIG. 1 shows that the lower side of the buoyant member 2 is located below a water level W. The buoyant member 2 has a vertical orientation when floating in the water. Its height is larger than its diameter, preferably more than three times its diameter.

The floating structure 1 is provided with a liquid piston gas compressor 4 for converting electrical energy into compressed gas which can be stored by the buoyant member 1. The liquid piston gas compressor 4 has a first vessel 5, a second vessel 6, a pump 7 and an electric motor 8 for driving the pump 7. The first and second vessels 5, 6 contain a liquid, for example water, which can be pumped between the first and second vessels 5, 6 by the pump 7. The floating structure 1 is also provided with a controller (not shown) for pumping the water from the first vessel 5 to the second vessel 6 and in reverse direction. The hatched areas in the first and second vessels 6 in FIG. 1 illustrate that the actual water level in the first vessel 5 is lower than in the second vessel 6. Above the water in the first and second vessels 5, 6 are respective compression chamber 5*a*, 6*a* which contain air to be compressed by the water in the first and second vessels 5, 6.

Under operating conditions of the liquid piston gas compressor 4 air is drawn from outside the buoyant member 2 into one of the first and second vessels 5, 6 in which the water level is decreasing, through one of corresponding closable inlets 9 and an air tube 10. At the same time air is compressed in the compression chamber 5*a*, 6*a* of the other one of the first and second vessels 5, 6 in which the water level is rising. The compression chambers 5*a*, 6*a* of the first and second vessels 5, 6 communicate with a pressure reservoir 11 through respective closable outlets 12. The closable inlets and outlets 9, 12 are also controlled by the controller. The inlet 9 of the first vessel 5 and the outlet 12 of the second vessel 6 may be open at the same time when the water is pumped from the first vessel 5 to the second vessel 6, whereas the inlet 9 of the second vessel 6 and the outlet 12 of the first vessel 5 are closed. This means that compressed air is transferred from the compression chamber 6*a* of the second vessel 6 to the pressure reservoir 11. Similarly, the inlet 9 of the second vessel 6 and the outlet 12 of the first vessel 5 may be open at the same time when the water is pumped from the second vessel 6 to the first vessel 5, whereas the inlet 9 of the first vessel 5 and the outlet 12 of the second vessel 6 are closed. In this case compressed air is transferred from the compression chamber 5*a* of the first vessel 5 to the pressure reservoir 11.

Since under operating conditions the water is pumped back and forth repetitively between the first and second vessels 5, 6 the liquid piston gas compressor 4 can be relatively small. This may be accomplished by means of operating the pump 7 in reverse direction, but it is also possible to apply a well-known switching valve for redirecting the flow to and from the first and second vessels 5, 6.

FIG. 1 shows that a large part of an enveloping wall of the pressure reservoir 11 coincides with the surrounding wall 3 of the buoyant member 2. This may minimize thermal resistance between the pressure reservoir 11 and the air and/or water surrounding the buoyant member 2. The surrounding wall 3 may be made of steel, but alternative materials that can withstand elevated pressure are conceivable. In practice, the pressure reservoir 11 may be designed to allow a working pressure of at least 14 bar.

Inside the pressure reservoir 11 is a ladder 13 which allows an operator to inspect or repair components at the lower portion of the buoyant member 2.

Figure 2:
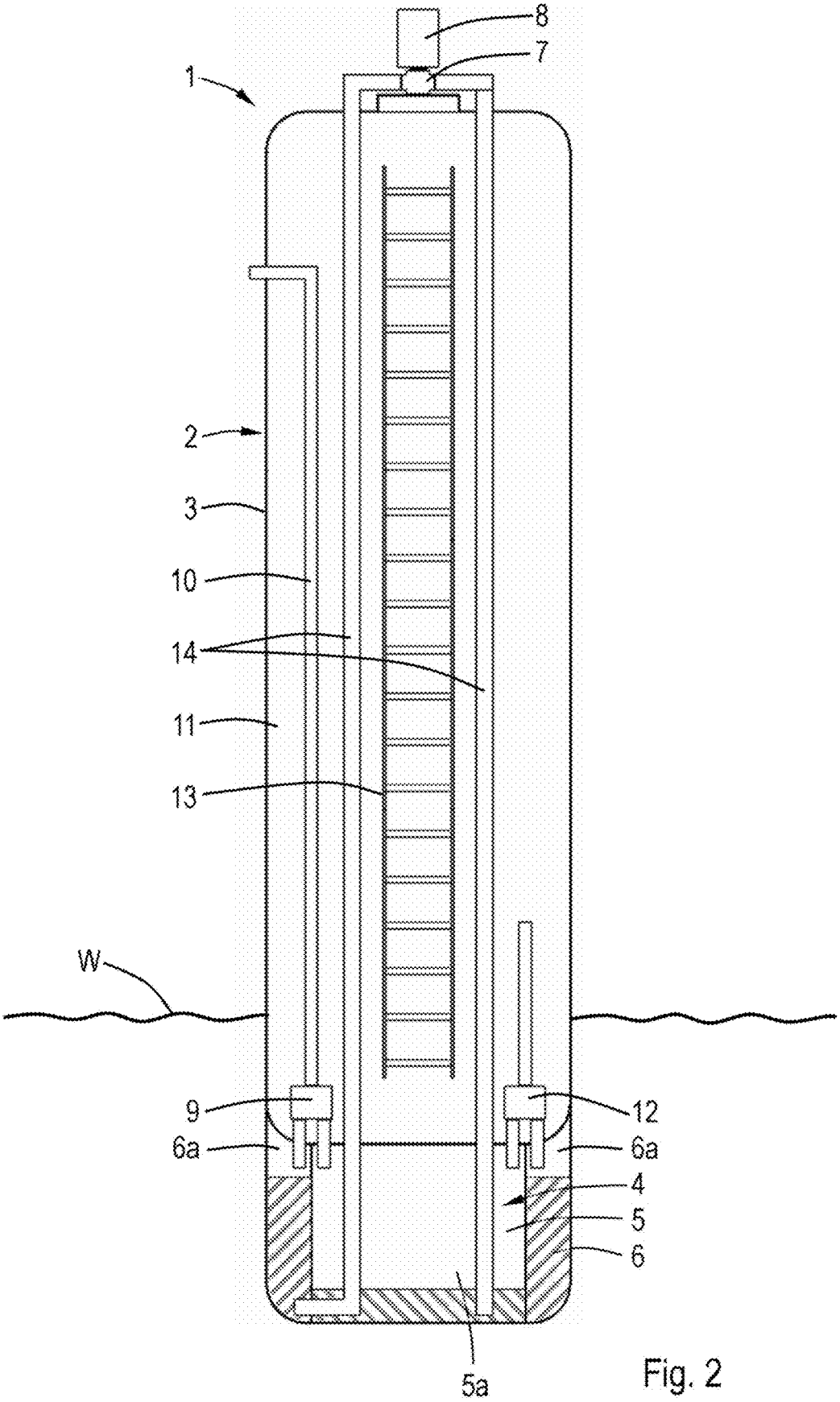
FIG. 2 is a similar view as FIG. 1, but showing an alternative embodiment.

In the embodiment as shown in FIG. 1 the pump 7 is located inside the first vessel 5, but it may be located at a different location as illustrated in FIG. 2. In the embodiment as shown in FIG. 2 features which correspond to features in the embodiment as shown in FIG. 1 have the same reference numbers. FIG. 2 shows that the pump 7 and the electric motor 8 are located at the upper side of the surrounding wall and at the outside thereof. This means that relatively long water pipes 14 are required between the pump 7 and the first and second vessels 5, 6, but the pump 7 and electric motor 8 are easily accessible for an operator.

In the embodiments as shown in FIGS. 1 and 2 the first and second vessels 6 are arranged concentrically with respect to each other. The second vessel 6 partly surrounds the first vessel 5. Furthermore, the second vessel 6 has a circumferential outer wall which coincides with the surrounding wall 3 of the buoyant member 2. Since the circumferential outer wall of the second vessel 6 is immersed in the surrounding water, efficient heat transfer between the surrounding water and the water and air in the second vessel 6 may be achieved.

Figure 3:
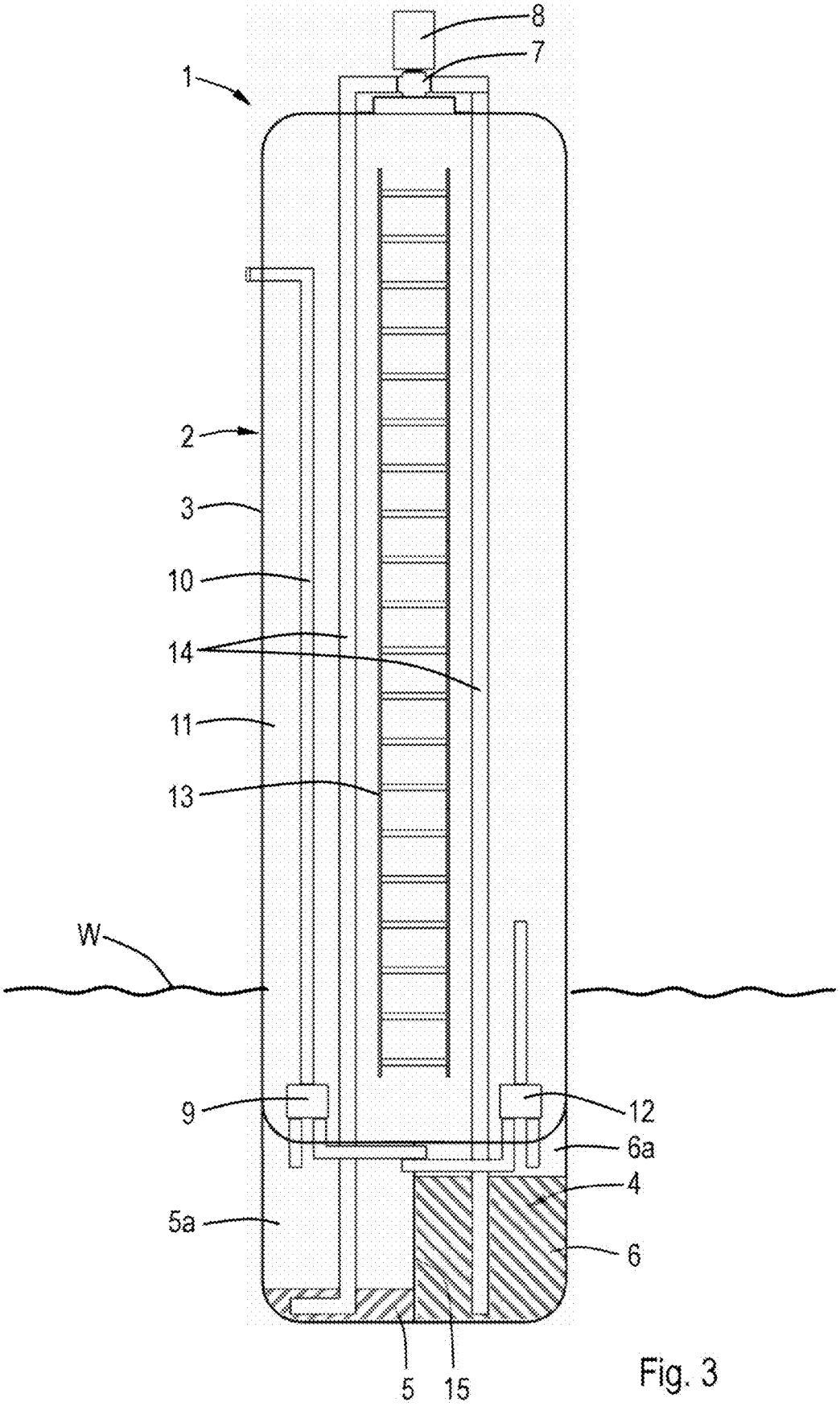
FIG. 3 is a similar view as FIG. 1, but showing another alternative embodiment

FIG. 3 shows an alternative embodiment in which the first and second vessels 5, 6 have a different arrangement. In the embodiment as shown in FIG. 3 features which correspond to features in the embodiment as shown in FIG. 2 have the same reference numbers. In this case the first and second vessels 5, 6 are separated by a partition 15. Numerous alternative arrangements are conceivable.

Figure 4:
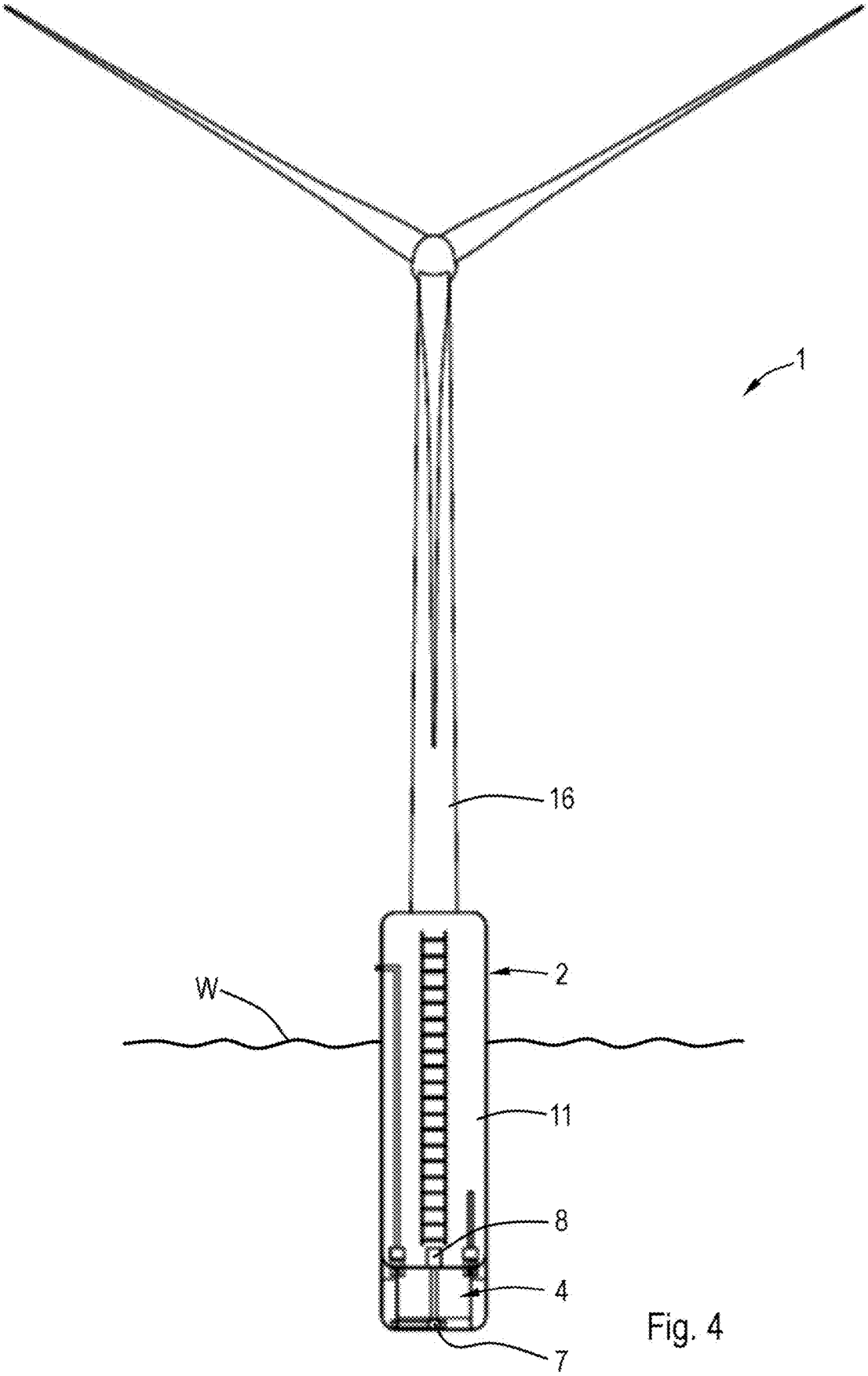
FIG. 4 is a sideview and partly sectional view of still another alternative embodiment of a floating structure.

FIG. 4 shows an alternative embodiment of the floating structure 1 wherein a wind turbine 16 is mounted on top of the buoyant member 2 as shown in FIG. 1. The liquid piston compressor 4 functions in a similar way as described above in relation to the embodiment as shown in FIG. 1. The wind turbine 16 forms an electrical power source collected from renewable energy and is electrically connected to the electric motor 8 through an electrical circuit (not shown) so as to operate the pump 7 by electrical energy from the wind turbine 16. If the generated electrical energy from the wind turbine 16 cannot be used for other electrical consumers it can be converted into compressed air and stored in the pressure reservoir 11.

Figure 5:
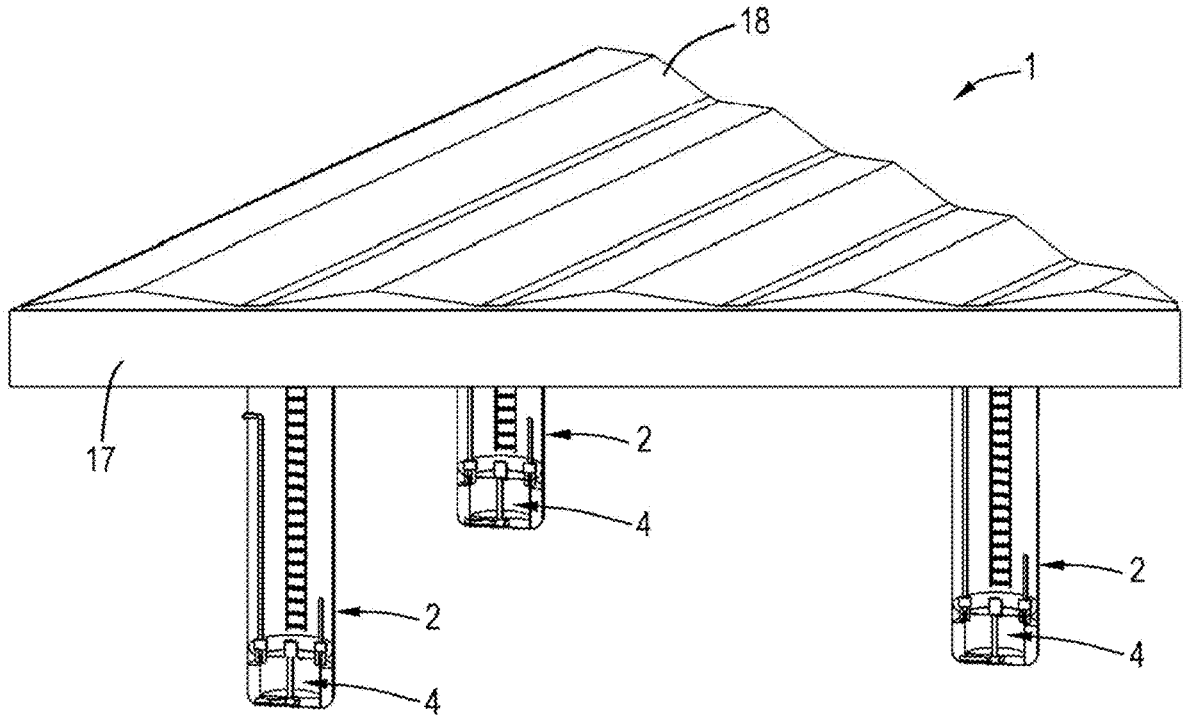
FIG. 5 is a perspective view and partly sectional view of still another alternative embodiment of a floating structure.

FIG. 5 shows another alternative embodiment of the floating structure 1. In this case the floating structure 1 comprises a triangular frame 17 which extends in a horizontal main plane and which may be part of a larger floating structure including a plurality of similar frames which are movably connected to each other. A plurality of PV panels 18 are mounted at an upper side of the frame 17 and three buoyant members 2 as shown in FIG. 1 are mounted at a lower side of the frame 17. Similar to the embodiment including the wind turbine 16 the PV panels 18 form an electrical power source collected from renewable energy which is electrically connected to the electric motor 8 of the liquid piston gas compressors 4 of the three buoyant members 2. In this embodiment each of the buoyant members 2 is provided with a liquid piston gas compressor 4, but it is also conceivable that only one of the buoyant members has a liquid piston gas compressor 4 whereas the other two are provided with pressure reservoirs 11 only for receiving compressed gas from the single liquid piston gas compressor 4.

Since the surrounding wall 3 of each of the buoyant members 2 is circular cylindrical between its upper side and lower side the projected contour of the surrounding wall 3 on the main plane has a size in a first direction which is equal to a size in a second direction perpendicular to the first direction. In an alternative embodiment the size in the first direction may be smaller than three or four times the size in the second direction. In the embodiment as shown in FIG. 5 the height of each of the buoyant members 2, i.e. in a direction which is perpendicular to the main plane, is larger than three times the diameter of the projected contour on the main plane.

It is conceivable to apply alternative (renewable) energy sources, for example a combination of PV panels and one or more wind turbines, a wave energy generator, etc.

It is described hereinbefore how electricity can be converted into compressed air and stored, but in order to recover electrical energy from the compressed air in the pressure reservoir 11 the liquid piston gas compressor 4 may be operable in reverse direction. The electric motor 8 may be operable as a generator such that expanding gas from the pressure reservoir 11 drives the pump 7, for example as a turbine, and the generator so as to generate electrical energy and supply this to the electrical circuit. This may happen under windless conditions in case of the wind turbine 16 or during the night in case of the PV panels 18.

The invention is not limited to the embodiments shown in the drawings and described hereinbefore, which may be varied in different manners within the scope of the claims and their technical equivalents.

The invention claimed is:

1. A floating structure, comprising a buoyant member including a surrounding wall within which a pressure reservoir for storage of compressed gas is provided and a compressor for supplying compressed gas to the pressure reservoir, wherein the compressor is a liquid piston gas compressor including two vessels for containing a liquid and a gas to be compressed above the liquid and a pump for pumping a liquid between the vessels, wherein at least the vessels are located within the surrounding wall of the buoyant member and are provided with respective closable inlets for receiving gas from outside the buoyant member and respective closable outlets through which the vessels communicate with the pressure reservoir so as to transfer compressed gas from the vessels to the pressure reservoir under operating conditions.

2. The floating structure according to claim 1, wherein the buoyant member has an upper side which lies above a lower side thereof when the floating structure is in an operational condition in which at least the lower side is immersed in water, wherein the vessels are located at a lower portion of the buoyant member and the pressure reservoir is located at an upper portion of the buoyant member.

3. The floating structure according to claim 1, wherein the pump is also located within the surrounding wall of the buoyant member.

4. The floating structure according to claim 3, wherein the pump is located inside one of the vessels.

5. The floating structure according to claim 1, wherein the pump is driven by an electric motor.

6. The floating structure according to claim 5, wherein under operating conditions the electric motor is electrically connected to an electrical power source through an electrical circuit so as to operate the pump by electrical energy from the electrical power source.

7. The floating structure according to claim 5, wherein the liquid piston gas compressor is operable in reverse direction and the electric motor is operable as a generator such that expanding gas from the pressure reservoir drives the pump and the generator so as to generate electrical energy.

8. The floating structure according to claim 1, wherein at least a portion of the surrounding wall forms an enveloping wall of the pressure reservoir.

9. The floating structure according to claim 1, wherein the pressure reservoir is configured such that its allowable working pressure is at least 14 bar.

10. The floating structure according to claim 1, wherein the gas is air.

11. The floating structure according to claim 1, wherein at least a portion of an outer wall of at least one of the vessels is formed by a part of the surrounding wall of the buoyant member.

12. The floating structure according to claim 11, wherein one of the vessels at least partly surrounds the other one of the vessels.

13. The floating structure according to claim 1, wherein the liquid is water.

14. The floating structure according to claim 1, wherein the floating structure comprises a frame to which the buoyant member is mounted, which frame extends in a main plane, wherein a projected contour of the surrounding wall of the buoyant member on the main plane has a size in a first direction which is smaller than six times a size in a second direction perpendicular to the first direction.

15. The floating structure according to claim 1, wherein the buoyant member has an upper side which lies above a lower side thereof when the floating structure is in an operational condition, wherein the distance between the upper side and the lower side is larger than three times the largest size of the surrounding wall in horizontal direction.

16. The floating structure according to claim 14, wherein the size in the first direction is smaller than three the size in the second direction.

17. The floating structure according to claim 14, wherein the size in the first direction is substantially equal to the size in the second direction.

18. The floating structure according to claim 6, wherein the electrical power source is preferably provided at the floating structure.

* * * * *